United States Patent [19]

Mandel

[11] Patent Number: 4,463,866

[45] Date of Patent: Aug. 7, 1984

[54] CONTAMINATION PROTECTION MEMBER FOR OPENING AND RESEALING DEVICE

[76] Inventor: George Mandel, 62 Long View Ct., Danville, Calif. 94526

[21] Appl. No.: 474,726

[22] Filed: Mar. 11, 1983

[51] Int. Cl.[3] ..... B65D 41/32; B65D 17/34

[52] U.S. Cl. ..... 220/269; 220/258

[58] Field of Search ..... 220/269, 258, 361, 379

[56] References Cited

U.S. PATENT DOCUMENTS

| | | | |
|---|---|---|---|
| 3,259,265 | 7/1966 | Stuart | 220/269 |
| 4,039,101 | 8/1977 | Wells | 220/258 X |
| 4,077,538 | 3/1978 | Waterbury | 220/269 X |
| 4,391,385 | 7/1983 | Rausing | 220/269 X |
| 4,407,424 | 10/1983 | Heyn | 220/269 |

*Primary Examiner*—Steven M. Pollard

*Attorney, Agent, or Firm*—Bielen and Peterson

[57] ABSTRACT

An improved integral opening and recapping device incorporated in the top of conventional aluminium top container constructed with an opening tab pivotally mounted to a pivot rivet centrally located on the container top, the tab having a detent edge engageable with a scored aperture flap for forced displacement of the flap to form an aperture, the tab having further a lever portion for operating the detent edge, the underside of the lever portion forming a sealing lip which on pivoting of the tab about the rivet, is engageable with the aperture to hermetically seal the container. The container top has a protective recess into which the sealing lip is nestled for protection of the lip from contamination prior to use.

4 Claims, 9 Drawing Figures

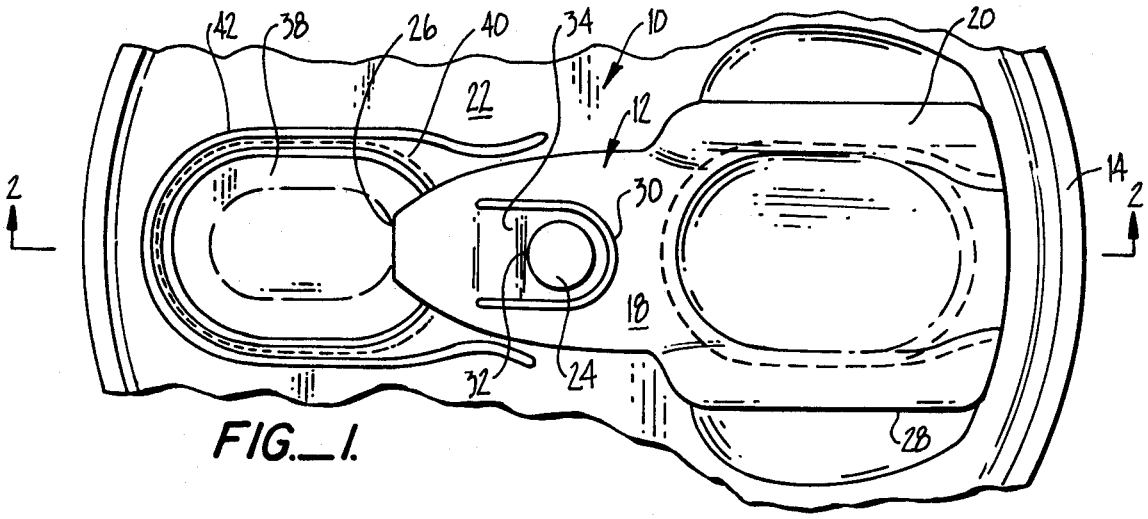
FIG._1.
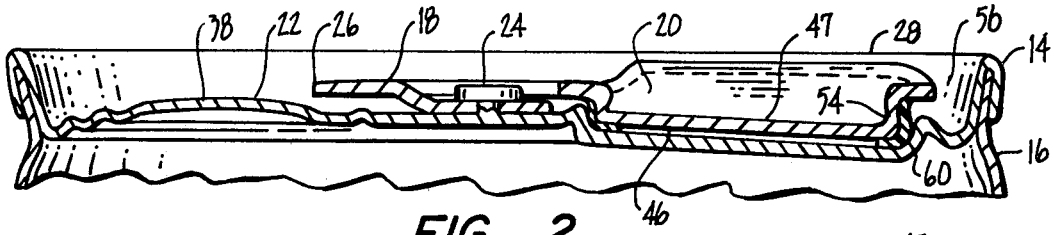
FIG._2.
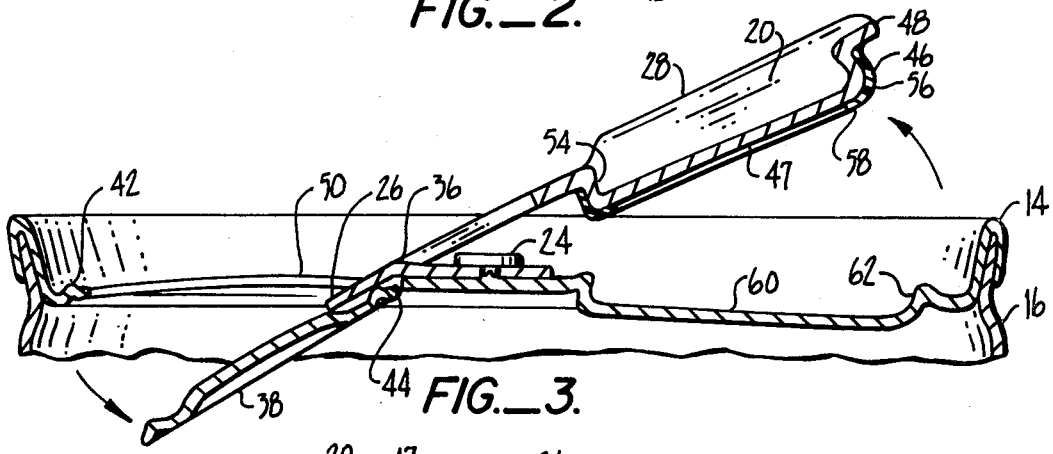
FIG._3.
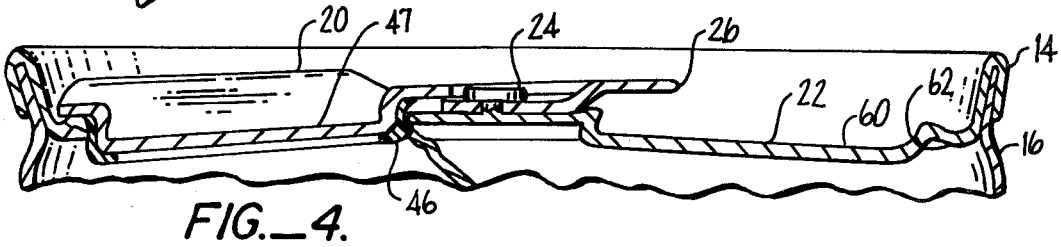
FIG._4.
FIG._5.
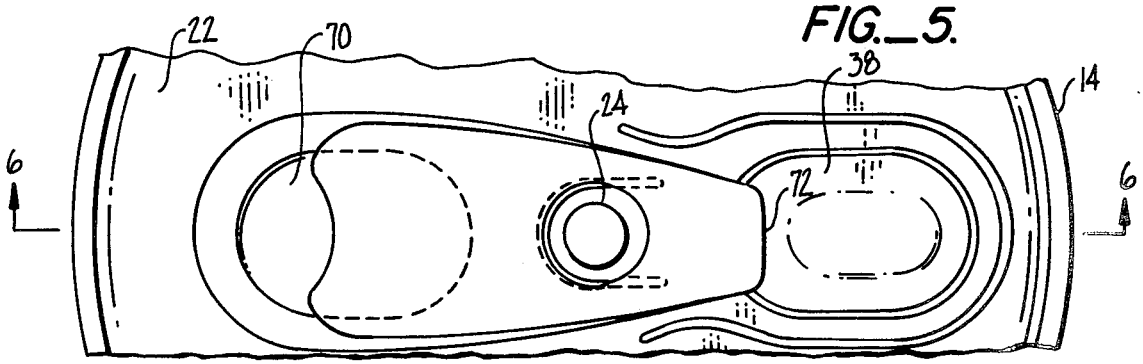

CONTAMINATION PROTECTION MEMBER FOR OPENING AND RESEALING DEVICE

BACKGROUND OF THE INVENTION

This invention relates to an opening and resealing device for cans having an aluminium top and comprises an improvement on the opening device described in my application for patent Ser. No. 427,500, Filed: Sept. 29, 1982 Entitled: Opening and Stopper Device now U.S. Pat. No. 4,433,792. The invention specifically relates to opening devices known as pop-tops of the antilitter type commonly used for beverage cans. The opening and resealing device is constructed with a sealing lip incorporated in the underside of the operating tab to form a stopper member to reseal the container. The improvement comprises a storage recess into which the sealing lip is nestled prior to use to prevent the lip from becoming contaminated with dirt and the like.

The operating tab is conventionally used for separating a prescored portion of the can top from the remaining top and depressing the flap from the can. The tap is conventionally connected to a rivet pin at the center of the can top and operates as a lever with a manual lifting portion on one side of the pin and a reacting detent portion on the other side of the pin, which engages the edge of the scored flap for depressing the flap into the can. Once opened, no provision on the tab mechanism has been provided for resealing the can. Certain plastic lid covers engageable with the circumferential rim of the can top are available for covering the entire top of the can and resealing the contents. Generally for the type of can usually employing a pop-top opening device, such covers are not provided with the can, and the user is most often left without a resealing means and must discard unconsumed contents with the can.

The opening and sealing device of this invention improves the mechanism conventionally used for opening beverage-type pop-top cans and integrally incorporates a sealing means into an altered opening tab and a protecting means into an altered container top for protecting the sealing means from contamination prior to use.

The resealing means comprises a projecting sealing lip, preferably of a semideformable composition that is integrally incorporated on the underside of the tab. The projecting sealing lip is nestled into a protective recess in the top of the can to prevent the lip from being inadvertently contaminated prior to use. Lifting the tab removes the sealing lip from the recess and concurrently engages a tab detent with a scored portion of the can top to form an aperture.

SUMMARY OF THE INVENTION

The opening and resealing device of this invention is an improvement in conventional pop-top type can opening devices. The improvement is directed to a stopper member incorporated directly in the tap portion of the opening mechanism, and permits the mechanism to function both as an opening device and a resealing device. Partially consumed contents of aluminium top can may be resealed at the option of the user at little or no additional cost in container fabrication.

The resealing means comprises a lip that projects from the underside of the tab and engages a protective recess in the top of a can. The sealing lip is constructed to conform to the aperture formed when the can is opened. The sealing lip is formed by stamping the tab during fabrication to provide a projection that is insertable into the drinking aperture. To improve the seal the formed lip is coated with a nylon or other deformable synthetic composition. The sealing lip is engaged by lifting the lip from the recess and pivoting the tab around the central pivot rivet until the lip is centered directly over the drinking aperture. The tab is then pressed downward to force the projecting lip on the underside of the tab into the aperture. To reopen, the tab is lifted under its distal edge, disengaging the lip from the aperture.

The resealing lip is designed to be integrally formed in the tab mechanism for aluminium top cans and is discarded with the can. While designed primarily for drinking containers, the opening and resealing device is suitable for a variety of aluminium top cans where only a portion of the top is to be opened. For example, sauce cans and peanut cans may be fabricated with a wide-mouth opening for pouring out the contents. The tab construction is simply of larger configuration to accomodate a comparatively large sealing lip on its underside. The size, however, is limited by the necessity of a pivot rivet located substantially in the central position of the top. Further, the size of the opening is restricted by the ability of the tab detent edge to initiate separation of the scored portion of the can top to form the dispensing aperture.

While formation of an insertion lip by stamping means and providing sealing film on the lip is most cost effective, the stopper member may be entirely formed of a rubber-like or deformable plastic material secured to the underside of a flat tab. However, this construction may be more likely to cause undesirable separation of the plastic material from the tab during reopening. The features of the preferred embodiment are described in greater detail in the description of the preferred embodiment.

BRIEF DESCRIPTION OF THE DRAWINGS

FIG. 1 is a fragmented top view of a container having the opening and resealing mechanism.

FIG. 2 is a fragmented side cross sectional view taken on the lines 2—2 in FIG. 1.

FIG. 3 is a fragmented side cross sectional view of the container of FIG. 1 with a tab member forming an aperture.

FIG. 4 is fragmented side cross sectional view of the container of FIG. 1, with a stopper member inserted in an aperture.

FIG. 5 is a fragmented top view of a container having an alternate embodiment of an opening and resealing mechanism.

DETAILED DESCRIPTION OF THE PREFERRED EMBODIMENTS

Figure 6:
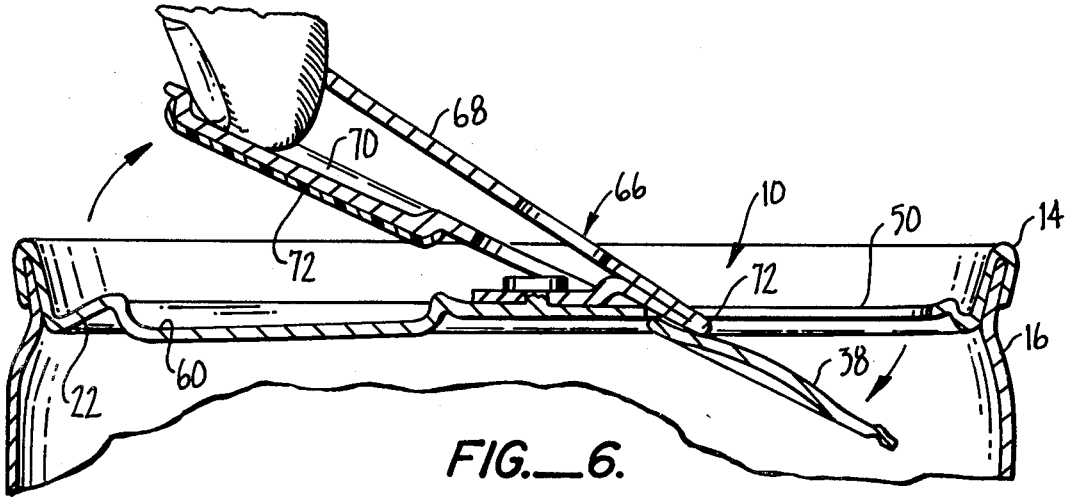
FIG. 6 is a fragmented side cross sectional view taken on the line 6—6 in FIG. 5.

Referring to FIG. 1 an aluminium top container 10 is shown with an opening and resealing device 12 of this invention. The container 10 has a peripheral rolled edge 14 of material of the same composition as the body 16 of the container shown in FIG. 2. This material in the preferred embodiment is aluminium, but may comprise steel as is common in certain bimetal containers. Alternately, the rolled edge may comprise a metal and the body of the container may comprise a plastic or cardboard as in certain containers for nuts of the like. The particular container shown is designed and sized for beverages, which is the principal expected use for the opening and resealing device shown.

The opening and resealing device comprises a tab mechanism 18, which includes a displaceable tab 20 connected to an aluminium container top 22 by a pivot rivet 24. The pivot rivet 24 pins the tab 20 to the container top as shown in FIG. 2 and permits the tab to be both lifted in part in lever fashion with the rivet generating a fulcrum point, and pivoted with the rivet functioning as a pivot post. The tab 20 has detent edge 26 on one side of the rivet 24 and a manual lever section 28 on the opposite side of the rivet. The tab 20 includes a semi-circular slit 30 which allows the lever section 28 to be manually lifted and the detent edge to be downwardly directed against the container top 22. The lever action is generated by the lead edge 32 of the rivet acting on the pinned section 34 of the tab to form a hinge crease 36.

The detent edge 26 of the tab 20 presses against an aperture flap 38 that initially is a composite section of the aluminium top defined by a scoring 40. The scoring 40 forms a horse shoe shaped loop in front of the detent edge and cooperates with a horse shoe flute 42, which stiffens the top, to facilitate separation of the flap from the remainder of the top as shown in FIG. 3. The flap 38 remains connected to the top by an unscored hinge portion 44 and is downwardly directed into the container out of the way of a user. The lever section 28 of the tab 20 as shown in FIG. 2 has a downwardly directed lip 46 on the underside of the tab which forms a stopper member 47.

The lip 46 is displaced from an angled terminal edge 48 to allow the tab to be easily engaged by the fingers of a user to open the container initially or to open the container after resealing. The outer configuration of the lip 46 conforms to the aperture 50 remaining when the flap 38 is displaced from the top on opening. As shown in FIG.3, the lip 46 is fabricated by stamping the tab to form a slightly outwardly angled face 54. The angled face 54 is coated with a plastic material 56 to form a filler film such that the finished face is substantially flat or preferably inwardly angled as the lip projects. This construction allows the lip 46 to be inserted into the aperture 50 as shown in FIG. 4 and resist dislocation.

Prior to opening the stopper member 47 is nestled in recess 60 stampeding container top 22. The recess 60 is constructed to conform to the configuration of the lip 46 to provide a sealed engagement when the stopper member is seated in the recess. In this manner, the sealing lip 46 is protected from contamination prior to its use in sealing the formed aperture. Dust dirt and debris deposited on the container top is prevented from contact with the sealing lip and the underside of the stopper member by the engagement of the lip with the peripheral edge 62 of the recess 60. In this manner contaminants are not transferred to the aperture or contents of the container when the stopper member is used. The plastic material compresses or deforms to conform to any irregularities in the matching of lip and aperture thereby providing a hermetic seal.

After opening, the pivot rivet allows the tab to be pivoted such that the lever section 28 and lip 46 is aligned over the complimentary configured aperture 50.

When the lever section 28 is downwardly pressed, the lip 46 on the tab is displaced into the aperture. Because the flap remains hinged to the top, the lip incidentally forces the flap further into the can during the sealing operation.

To reopen the container, the upwardly angled terminal edge 48 of the tab is engaged by the user's finger tips and lifted. The tab is then pivoted to an out of the way position. The resealing device can be reused until the contents of the container are gone.

Referring to FIGS. 5 and 6 an alternate embodiment of a tab mechanism 66 is shown. The tab mechanism includes a displaceable lifting tab 68 incorporated on the pivot rivet 24 on top of a pivotal stopper member 70. The tab 68 has a detent edge 72 which engages the aperture flap 38 to depress the flap 38 when the tab 68 is lifted as shown in FIG. 6. After the flap 38 is displaced the tab mechanism 66 is pivoted and the stopper member 70 inserted into the aperture 50 in a manner similar to that formerly shown in the embodiment of FIG. 4.

For convenience of fabrication, the edge and bottom of the stopper member 70 is coated with a deformable coating 72 to provide for hermetic sealing of the aperture 50 when the stopper member 70 is pressed into the aperture.

In a similar fashion with the first described embodiment, the container top 22 includes a recess 60 for sealed retention of the stopper member 70 prior to use to prevent inadvertent contamination of the stopper member.

Figure 7:
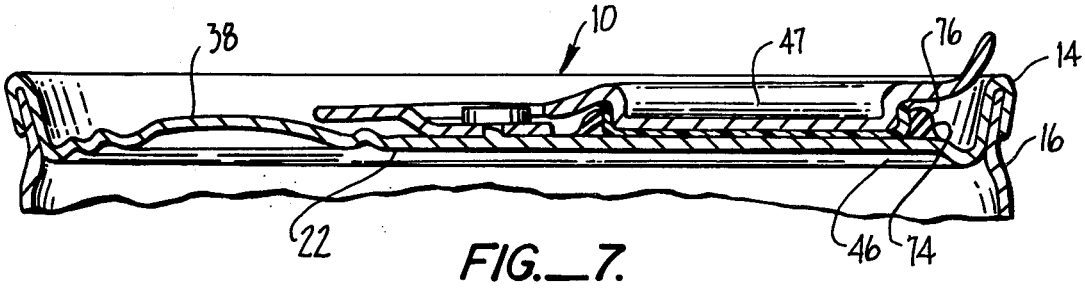
FIG. 7 is a fragmented side cross sectional view of a container having a second alternate embodiment of an opening and resealing mechanism.

Referring to FIG. 7, an alternate embodiment of a recess structure 74 for preoperative retention of the stopper member 47 is shown. The recess structure 74 is formed by a raised ring 76 of a hard plastic substance which adheres to the top 22 of the container. The ring 76 engages the sealing lip 46 of the stopper member and protects the lip 46 and underside of the stopper member 47 from contamination.

The above described embodiments set forth certain examples of the improved opening and recapping device incorporating the stopper member of my earlier described application and my preoperative storage recess for precention contamination of the stopper. These features may be included in tab tap containers having tab mechanisms of different construction.

Figure 8:
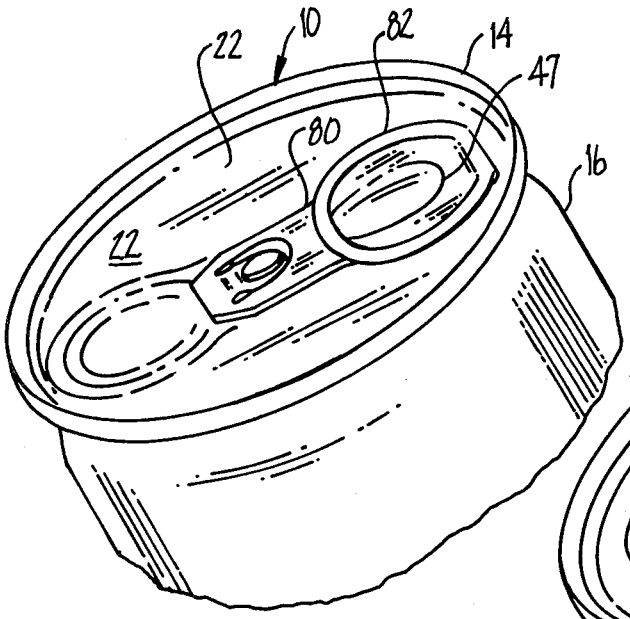
FIG. 8 is a fragmented perspective view of a container having a third alternate embodiment of an opening and resealing mechanism.
Figure 9:
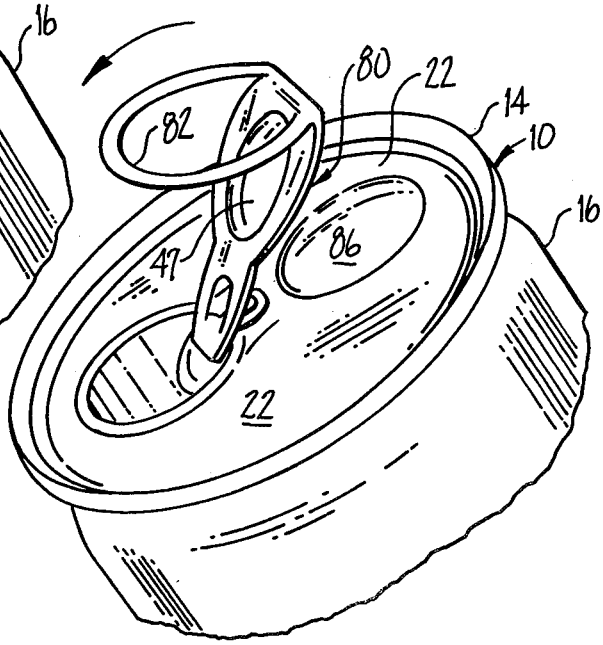
FIG. 9 is a fragmented perspective view of the container of FIG. 8 with tab mechanism in an operating position.

For example in FIGS. 8 and 9, a tab mechanism 80 with a pull ring 82 for activating the detent 84 that engages the aperture flap 38 includes an underlying stopper member 47. The can top 22 includes a recess 86 for prevention of contaminations in which the stopper member is nestled prior to use. Other constructions of a tab mechanism may similarly be devised to include the stopper and contamination preventing storage recess as described herein.

While on the foregoing embodiments of the present invention have been set forth in consideration detail for the purposes of making a complete disclosure of the invention, it may be apparent to those of skill in the art that numerous changes may be made in such detail without departing from the spirit and principles of the invention.

What is claimed is:

1. In a container having an aluminium top with a pivotal tap opening mechanism engaging a scored flap in said top for forming a contents dispensing aperture, said tab opening mechanism including a resealing stopper member thereon, for hermetically resealing said aperture when said stopper member is pivoted over said aperture and pressed into said aperture, the improvement comprising:

a storage recess incorporated on said container top engageable with said stopper member, said storage recess having a peripheral edge and said stopper member having a sealing lip which contacts said peripheral edge and protects said edge and the underside of said stopper member from contaminants when said stopper member is nestled in said recess.

2. The improvement of claim 1 wherein said storage recess is stamped into said container top.

3. The improvement of claim 1 wherein said storage recess is formed by a raised ring of material added to said container top.

4. The improvement of claim 3 wherein said ring is fabricated from a plastic material adhered to said container top.

* * * * *